US006758528B2

(12) United States Patent
Kawashima

(10) Patent No.: US 6,758,528 B2
(45) Date of Patent: Jul. 6, 2004

(54) CUSHION STRUCTURE MANUFACTURING METHOD AND APPARATUS OF THE SAME

(75) Inventor: Takehiko Kawashima, Hashima (JP)

(73) Assignee: Asahi Gomu Kako Co., Ltd., Aichi (JP)

( * ) Notice: Subject to any disclaimer, the term of this patent is extended or adjusted under 35 U.S.C. 154(b) by 0 days.

(21) Appl. No.: 09/748,203

(22) Filed: Dec. 27, 2000

(65) Prior Publication Data

US 2001/0040404 A1 Nov. 15, 2001

(30) Foreign Application Priority Data

Dec. 28, 1999 (JP) ..... 11-372849
Dec. 28, 1999 (JP) ..... 11-372850

(51) Int. Cl.[7] ..... A47C 7/02
(52) U.S. Cl. ..... 297/452.56
(58) Field of Search ..... 297/452.56, 452.55, 297/452.1

(56) References Cited

U.S. PATENT DOCUMENTS 5,013,089 A * 5/1991 Abu-Isa et al.
6,152,534 A * 11/2000 Maeda et al.
6,231,125 B1 * 5/2001 Maeda et al.
6,375,269 B1 * 4/2002 Maeda et al.

FOREIGN PATENT DOCUMENTS

JP 11-290153 10/1999

* cited by examiner

*Primary Examiner*—Milton Nelson, Jr.
(74) *Attorney, Agent, or Firm*—Reed Smith LLP; Stanley P. Fisher, Esq.; Juan Carlos A. Marquez, Esq.

(57) ABSTRACT

A cushion structure used as a seat cushion or backrest of a seat, which is composed of a square net stretched on a square frame of combined structure composed of an elastic square frame body and a hard square frame body embedded in the elastic square frame body, wherein each side end portion of the square net is rolled up on the elastic square frame body of the square frame and fastened to the hard square frame body of the square frame.

5 Claims, 7 Drawing Sheets

CUSHION STRUCTURE MANUFACTURING METHOD AND APPARATUS OF THE SAME

BACKGROUND OF THE INVENTION

1. Field of the Invention

The present invention relates to a cushion structure used as a seat cushion or backrest of various seats and to a manufacturing method and apparatus of the cushion structure.

2. Description of the Prior Art

Disclosed in Japanese Patent Laid-open Publication No. 11-290153 is a cushion structure the surface of which is formed with a square net rolled up on a metallic square frame at each side end portion thereof and stretched on the frame by adhered thereto. The cushion structure is superior in elastic cushion property in a simple construction since the resiliency of the stretched net is useful to enhance the cushion property of the structure without causing a hardness feeling and a bottomed feeling. Accordingly, the cushion structure can be used as a seat cushion or backrest of various seats. However, the cushion property of the structure is influenced in dependence upon only the resiliency of the stretched net.

During the manufacturing process of the cushion structure, a square die formed with a square groove corresponding with the configuration of the frame is used for setting thereon the square net in place. In a condition where the square net was set on the die, the square frame is coupled with the corresponding square groove of the die so that the square net is rolled up on the square frame at each side end portion thereof and adhered to the square frame in place by thermoplastic resin in a melted condition. When the square frame is coupled with the corresponding square groove of the die, the whole portion of the square net except for each side end portion is brought into contact with the surface of the die surrounded by the square groove and restricted in a stretched condition. With such a setting method, it is difficult to uniformly adjust the tension of the square net in a desired value.

SUMMARY OF THE INVENTION

It is, therefore, a primary object of the present invention to provide a cushion structure in which a quadrilateral or square (hereinafter the two terms are simply stated as "square") frame of combined structure composed an elastic frame body and a hard frame body embedded in the elastic frame body is used to enhance the cushion property of the structure by combination of the resiliency of the stretched net and the resiliency of the elastic frame body.

A secondary object of the present invention is to provide a method and apparatus suitable for manufacturing the cushion structure in a simple manner.

According to the present invention, the object is accomplished by providing a cushion structure used as a seat cushion or backrest of a seat, comprising a square net stretched on a square frame of combined structure composed of an elastic square frame body and a hard square frame body embedded in the elastic square frame body, wherein each side end portion of the square net is rolled up on the elastic square frame body of the square frame and fastened to the hard frame body of the square frame. In the cushion structure, it is preferable that a mounting plate adhered to each side end portion of the square net is fastened to the hard square frame body.

According to an aspect of the present invention, there is provided a manufacturing method of a cushion structure the surface of which is formed with a square net rolled up on a square frame at each side end portion thereof and stretched on the square frame by fastened thereto, wherein the manufacturing method comprises the steps of retaining a square net on a support bed in a flat condition, placing a square frame combined structure in position on the square net retained on the support bed, the square frame being composed of an elastic square frame body and a hard square frame body embedded in the elastic square frame body, pressing the square frame of combined structure toward the square net to roll up each side end portion of the square net on each frame portion of the elastic square frame body of the square frame, and fastening each side end portion of the square net to the hard square frame body of the square frame.

According to another aspect of the present invention, there is provided a manufacturing apparatus of a cushion structure the surface of which is formed with a square net roller up on a square frame at each side end portion thereof and stretched on the square frame by fastened thereto, wherein the manufacturing apparatus comprises a square support bed for retaining a square net thereon in a flat condition, a plurality of clamping mechanisms mounted on the support bed for clamping each side end portion of the square net retained on the support bed, and a plurality of pressure mechanisms mounted on the support bed for pressing a square frame placed on the square net clamped by the clamping mechanisms so that each side end portion of the square net is rolled up on each frame portion of the square frame.

Other object, features and advantages of the present invention will be more readily appreciated from the following detailed description of a preferred embodiment thereof when taken together with the accompanying drawings, in which.

DESCRIPTION OF THE PREFERRED EMBODIMENT

Figure 1:
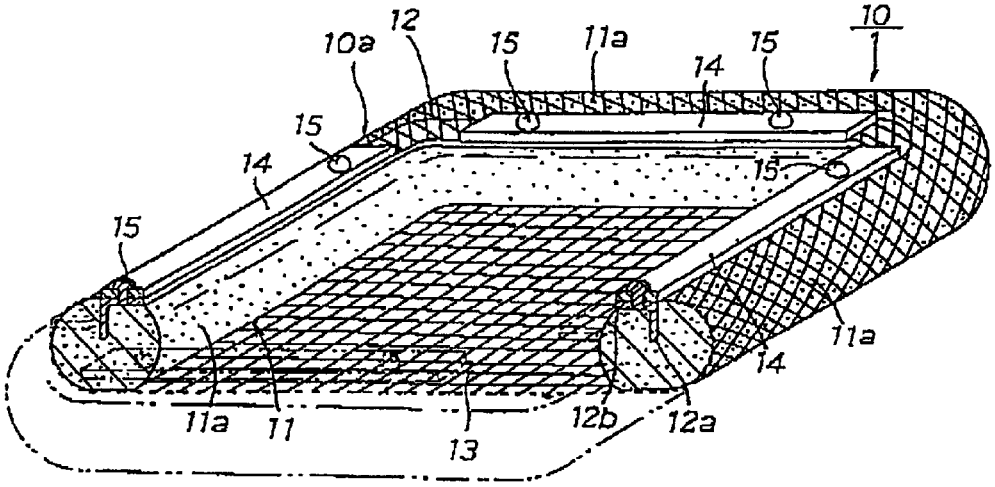
FIG. 1 is a partly broken perspective view illustrating a bottom of a cushion structure in accordance with the present invention.
Figure 2:
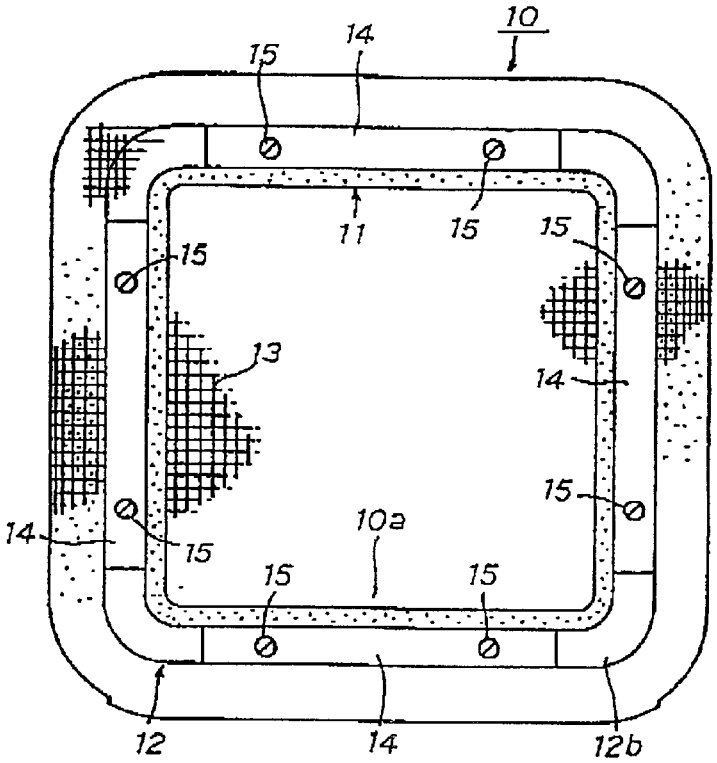
FIG. 2 is a plan view illustrating the bottom of the cushion structure shown in FIG. 1.

Illustrated in FIGS. 1 and 2 of the drawings is a preferred embodiment of a cushion structure 10 in accordance with the present invention. FIG. 1 is a partly broken perspective view illustrating a bottom of the cushion structure 10, and FIG. 2 is a plan view illustrating the bottom of the cushion structure 10. In this embodiment, a square frame 10*a* of combined structure composed of an elastic square frame body 11 made of sponge and a hard square frame body 12 of metal embedded in the elastic square frame 11 is used for the cushion structure 10. To provide the cushion structure 10, a square net 13 made of ultra-strong polyester threads woven meshes is stretched on the square frame 10*a*.

Figure 3:
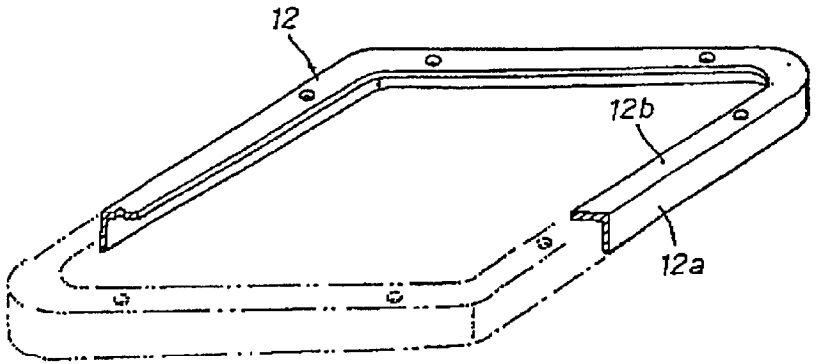
FIG. 3 is a partly broken perspective view of a hard frame body used for the cushion structure shown in FIG. 1.
Figure 12:
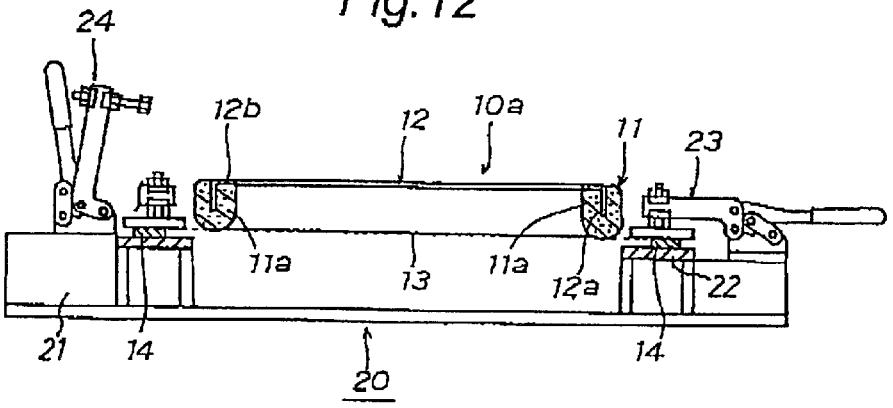
FIG. 12 is a schematic illustration of an operated condition of the manufacturing apparatus at a second step for manufacturing the cushion structure.

As shown in FIGS. 1 and 2, the elastic frame body 11 is formed in a circular cross-section in a condition where it has been assembled in the cushion structure 10. Before assembled in the cushion structure 10, the elastic frame body 11 is formed semi-oval in cross-section as shown in FIG. 12. As shown in FIGS. 1 and 3, the hard square frame boy 12 is in the form of a square frame of L-letter shape in cross-section and is integrally embedded in the elastic square frame 11 and exposed in a condition where a flat portion 12*b* of the frame is maintained in contact with a flat portion of the elastic square frame 11.

Figure 4:
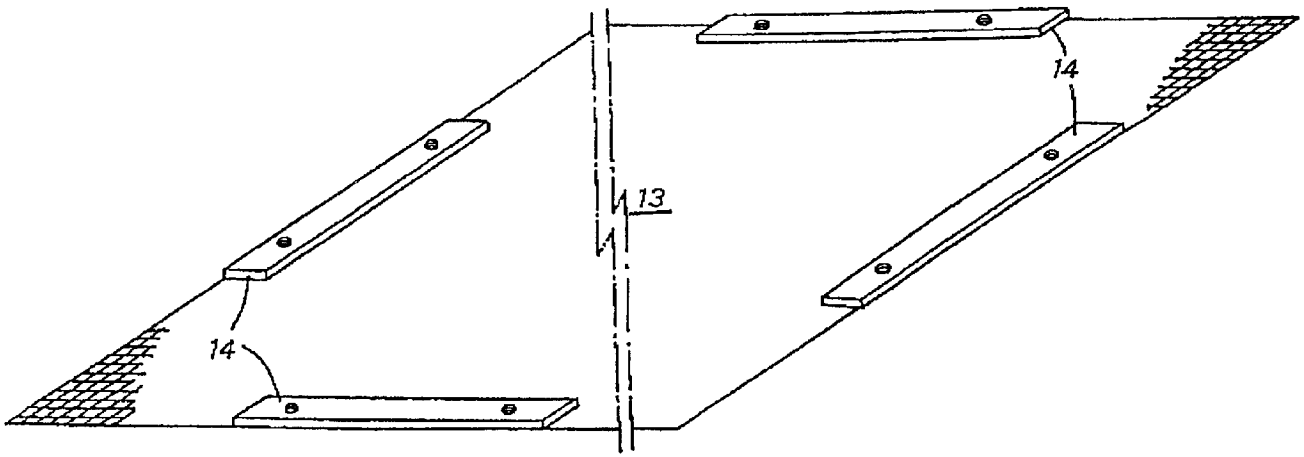
FIG. 4 is a perspective view of a square net used for the cushion structure shown in FIG. 1.

As shown in FIGS. 1, 2 and 4, a mounting plate 14 is adhered to each side end portion of the square net 13 by means of an adhesive agent of thermoplastic resin. For adhesion of the mounting plate 14, an amount of polyester synthetic resin powder is heated at about 260° C. and brought into contact with the mounting plate 14. In a condition where the resin powder is maintained in a melted condition, the mounting plate 14 is placed on each side end portion of the square net 13, and the melted resin powder is hardened by cooling under pressure. Thus, the mounting plate 14 is firmly adhered to each end portion of the square net 13.

In the cushion structure 10, the square net 13 is rolled up at each side end portion thereof on each frame portion 11*a* of the elastic frame body 11, and the mounting plate 14 is fixed to the flat portion 12*b* of hard frame body 12 by means of bolts 15 in a condition where the square net 13 is maintained in its rolled up position. In such a condition, each frame portion 11*a* of the elastic frame body 11 is compressed by each side end portion of square net 13 and formed in a circular cross-section. Thus, the net 13 is uniformly stretched on the square frame 10*a* of combined structure composed of the elastic frame body 11 and hard frame body 12 and retained in place with a desired tension.

In the cushion structure 10, the net 13 is placed at the upper surface of the square frame 10*a* of combined structure in a condition where each side end portion of the net 13 is rolled up on each frame portion 11*a* of the elastic frame body 11 and fixed to the flat portion 12*b* of hard frame body 12 at the bottom surface of the square frame 10*a*. With such a construction, the resiliency of elastic frame body 11 is added to the resiliency of net 13 to enhance the cushion property of the structure 10. As in the cushion structure 10, each side end portion of square net 13 is fixed to the flat portion 12*b* of hard frame body 12 through each frame portion 11*a* of elastic frame body 11, the elastic frame body 11 is useful to eliminate a difference in tension of the net 13 and to retain the entirety of net 13 in a uniformly stretched condition. This is useful to provide the cushion structure 10 without causing any local difference in cushion property. The cushion structure 10 with such property can be adapted as a seat cushion or backrest of various seats or as a cushion frame of the seat cushion or backrest.

Figure 5:
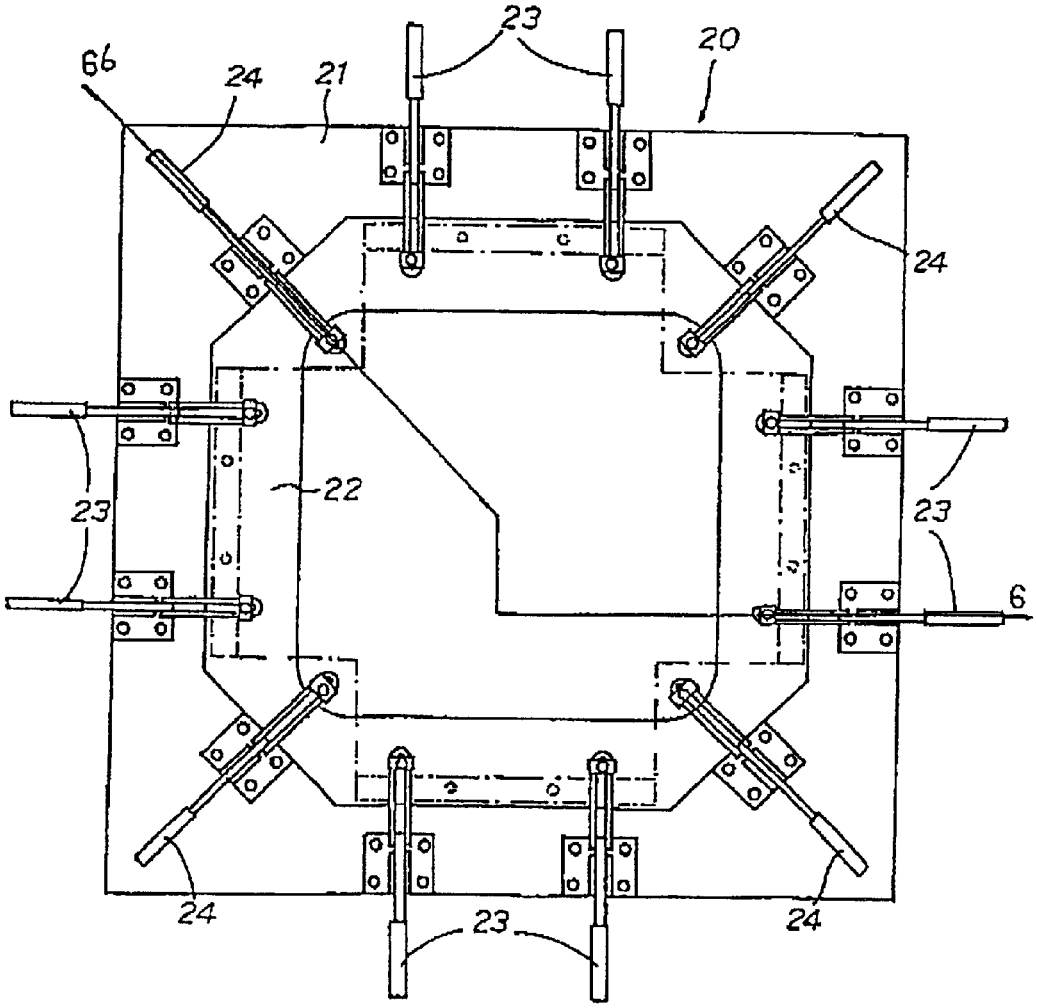
FIG. 5 is a plan view of a manufacturing apparatus of the cushion structure shown in FIG. 1.
Figure 6:
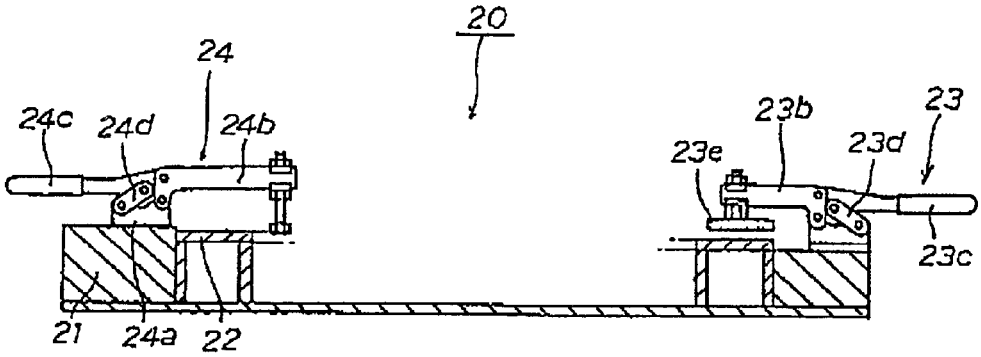
FIG. 6 is a sectional view taken along line 6—6 in FIG. 5.
Figure 10:
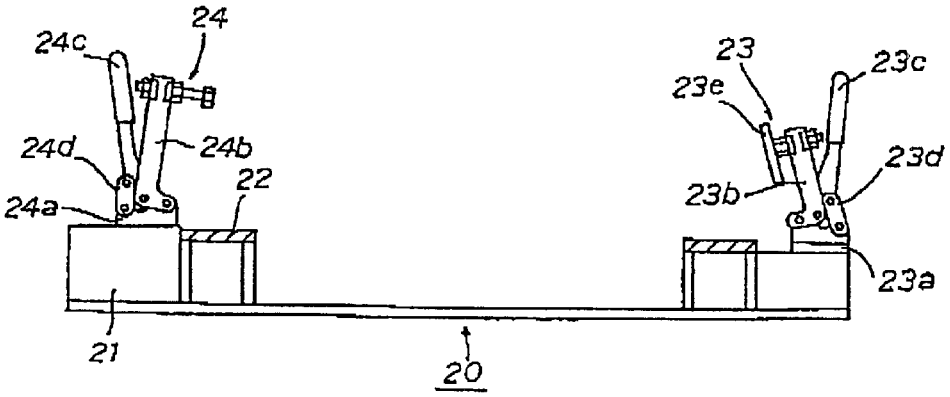
FIG. 10 is a schematic illustration of the manufacturing apparatus in a condition immediately before used for manufacturing the cushion structure shown in FIG. 1.

The cushion structure 10 can be manufactured by manufacturing steps shown in FIGS. 11 to 14 in use of a manufacturing apparatus 20 shown in FIGS. 5, 6 and 10. As shown in FIG. 5, the manufacturing apparatus 20 is composed of an outer support bed 21 in the form of a square frame, an inner support bed 22 in the form of a square frame disposed in the support bed 21, a plurality of clamping mechanisms 23, and a plurality of pressure mechanisms 24. The clamping mechanisms 23 are arranged in a pair and opposed to each other respectively at the left and right sides of support bed 21 and at the front side and backside of outer support bed 21. The pressure mechanisms 24 are arranged at each corner of the support bed 21 and opposed to one another.

Figure 7:
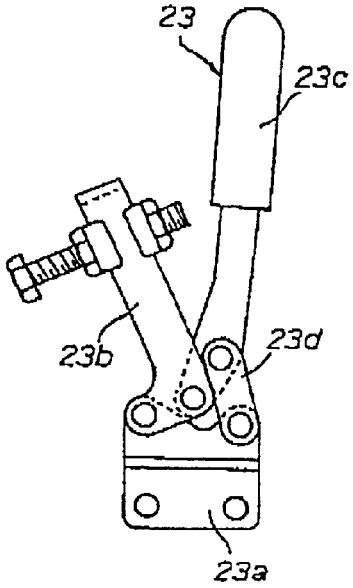
FIG. 7 is a side view of a clamping mechanism in an operated condition shown in FIG. 5.
Figure 8:
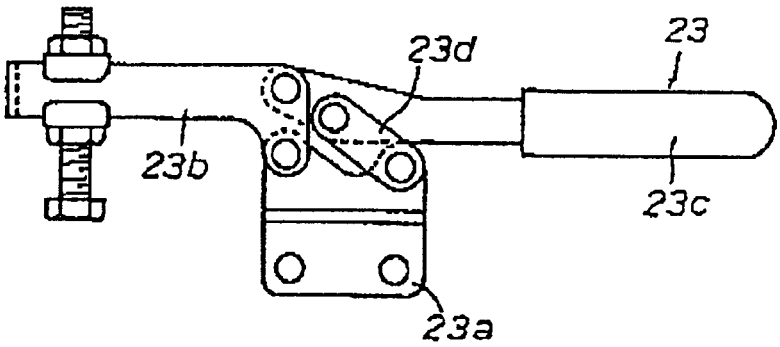
FIG. 8 is a side view of the clamping mechanism in an operated condition.
Figure 9:
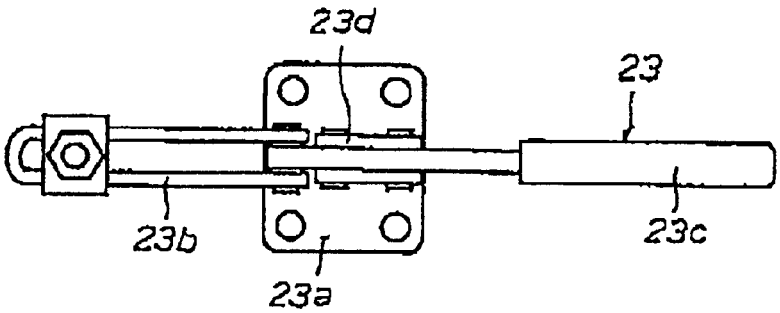
FIG. 9 is a plan view of the clamping mechanism in an operated condition.

As shown in FIGS. 6 to 9, the clamping mechanisms 23 each are composed of a support bracket 23*a*, a clamping lever 23*b*, an operation lever 23*c* and a connecting arm 23*d*. The clamping lever 23*b* is pivotally mounted at its rear end portion on a front portion of support bracket 23*a* for rotary movement in a vertical direction. The operation lever 23*c* is pivotally connected at its front end to the rear end portion of clamping lever 23*b* for rotary movement in a vertical direction. The connecting arm 23*d* is pivotally mounted at its rear end on a rear end portion of support bracket 23*a* for rotary movement in a vertical direction and pivotally connected at its front end to an intermediate portion of operation lever 23*c* for rotary movement in a vertical direction. The support bracket 23*a* is mounted on the support bed 21 to place the clamping mechanism 23 in position. When the clamping mechanism 23 is in an inoperative condition, the operation lever 23*c* is retained in an upward position as shown in FIG. 7 to retain the clamping lever 23*b* in an upward position. When the operation lever 23*c* is moved downward to rotate in a clockwise direction, the clamping lever 23*b* is rotated in a counterclockwise direction and retained in a horizontal condition to be pressed on the inner support bed 22 as shown in FIG. 8.

As shown in FIG. 6, the pressure mechanisms 24 each are substantially the same in construction as the clamping mechanism 23. Namely, the pressure mechanisms 24 each are composed of a support bracket 24*a*, a pressure lever 24*b*, an operation lever 24*c* and a connecting arm 24*d*. When the operation lever 24*c* is moved downward, the pressure lever 24*b* is rotated in a clockwise direction and retained in a horizontal condition to be pressed inside the inner support bed 22.

Figure 11:
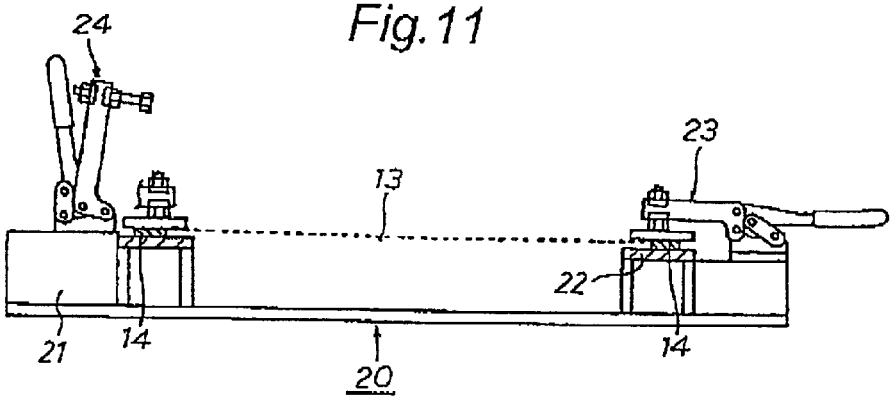
FIG. 11 is a schematic illustration of an operated condition of the manufacturing apparatus at a first step for manufacturing the cushion structure.
Figure 13:
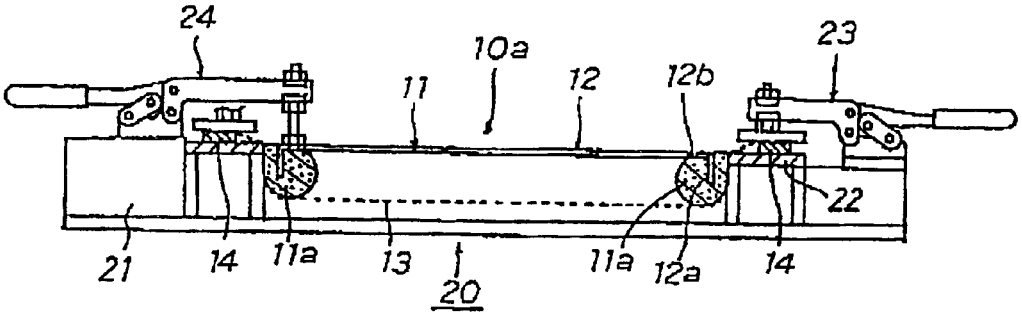
FIG. 13 is a schematic illustration of an operated condition of the manufacturing apparatus at a third step for manufacturing the cushion structure.
Figure 14:
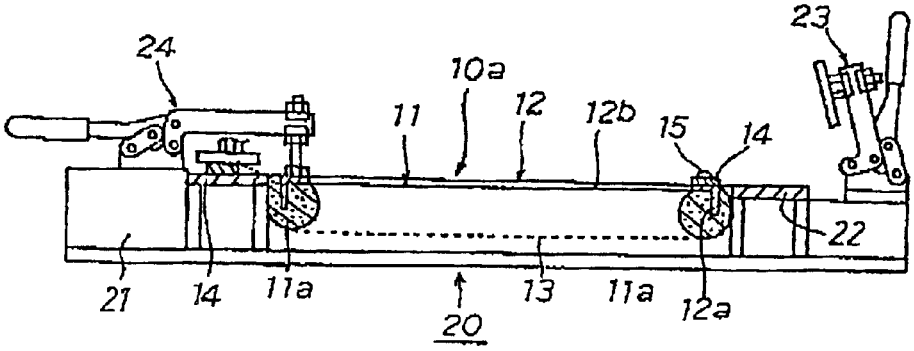
FIG. 14 is a schematic illustration of an operated condition of the manufacturing apparatus at a fourth step for manufacturing the cushion structure.

Illustrated in FIGS. 11 to 14 is a manufacturing process of the cushion structure 10. In FIG. 10, there is illustrated an inoperative condition of the manufacturing apparatus 20. The manufacturing process of the cushion structure 10 is carried out by the steps of retaining the square net 13 on the inner support bed 22 in a flat condition as shown in FIG. 11, putting the square frame 10*a* of combined structure on the square net 13 supported on the inner support bed 22 as shown in FIG. 12, pressing the square frame 10*a* of combined structure to roll up each side end portion of the square net 13 on each frame portion 11*a* of the elastic frame body 11 as shown in FIG. 13, and fastening each side end portion of the rolled up square net 13 to the flat portion 12*b* of the hard square frame body 12 as shown in FIG. 14.

In use of the manufacturing apparatus 20, a rubber plate 23*e* for prevention of slippage is attached to each distal end of the clamping lever 23*b* as shown in FIG. 6, and the manufacturing apparatus 20 is set in an inoperative condition as shown in FIG. 10. At the first step of the manufacturing process shown in FIG. 11, the square net 13 is placed on the inner support bed 22, and each operation lever 23*c* of the clamping mechanisms 23 is operated to bring the rubber plate 23*e* attached to the clamping lever 23*b* into contact with each mounting plate 14 on the square net 13. Thus, the square net 13 is clamped by the clamping lever 23*b* at eight portions thereof on the inner support bed 22 and retained on the support bed 22 in a flat condition as shown in FIG. 11.

At the second step of the manufacturing process shown in FIG. 12, the square frame composed of the elastic frame body 11 and hard frame body 12 is placed in position on the square net 13 horizontally supported on the inner support bed 22. At the third step of the manufacturing process shown in FIG. 13, the operation levers 24*b* of pressure mechanisms 24 are operated to bring the pressure levers 24*b* into contact with the flat portion 12*b* of the hard frame body 12 and to press the square frame 10*a* downward against the square net 13. Thus, each frame portion 11*a* of the square frame 11 is compressed into circular in cross-section, and the square net 13 is rolled up at each side end portion thereof on the square frame 11 and stretched with a predetermined tension. In such operation of the pressure mechanisms 24, it is desirable to mutually operate the pressure mechanisms 24 opposed to each other.

At the fourth step of the manufacturing process shown in FIG. 14, the operation levers 23*b* of clamping mechanisms 23 are successively released from the stretched net 13, and the mounting plate 14 is placed in position on the flat portion 12*b* of hard frame body 12 at the released portion of the stretched net 13 and fixed to the hard frame body 12 by bolts 15. In this instance, it is desirable to release the clamping mechanisms 23 opposed to each other thereby to successively fasten the mounting plate 14 to the hard frame body 12 at the released end portion of the stretched net 13.

With the manufacturing process described above, the cushion structure 10 is manufactured with the net 13 stretched with a predetermined tension on the elastic frame body 11. In the cushion structure, the resiliency of elastic frame body 11 is added to the resiliency of net 13 to enhance the cushion property of the cushion structure 10 superior in elasticity without causing any local difference in the cushion property.

During the manufacturing process, the square net 13 retained in place on the support bed 22 is stretched by the square frame 10*a* pressed thereon and rolled up at each side end portion thereof on the elastic frame body 11. Subsequently, the mounting plate 14 is fastened to each frame portion of the hard frame body 12 to retain the net 13 in the stretched condition. Thus, the tension of the net 13 can be adjusted by the pressure force applied to the square frame 10*a*.

What is claimed is:

1. A cushion structure used as a seat cushion or backrest of a seat, comprising a quadrilateral frame of combined structure composed of an elastic quadrilateral frame body of elastic material and a hard quadrilateral frame body with one part embedded in the elastic quadrilateral frame body and another part secured with a rim of a quadrilateral net, said quadrilateral net is rolled up at a peripheral portion to be around a bottom surface and an external surface of the elastic quadrilateral frame body and to be secured at the rim in a uniformly stretched condition so as to form a support portion of the seat cushion or backrest.

2. A cushion structure as claimed in claim 1, wherein a mounting plate is adhered to the rim of said quadrilateral net so as to secure said another part of the hard quadrilateral flame body with the rim with the rim placed between the mounting plate and said another part of the hard quadrilateral frame body.

3. A cushion structure as claimed in 1, wherein the elastic quadrilateral frame body of said quadrilateral frame is made of sponge, and the hard quadrilateral frame body of said quadrilateral frame is made of metal.

4. A cushion structure as claimed in claim 1, wherein the elastic quadrilateral frame body comprises an elastic square frame with a circular cross-section and made of sponge, and the quadrilateral net is a square net made of polyester threads woven in meshes.

5. A cushion structure as claimed in claim 4, wherein the hard quadrilateral frame body is a square metallic frame of a L-shaped cross-section with one arm of the L embedded in the elastic quadrilateral frame body and another arm of the L secured with the rim of the quadrilateral net.

* * * * *